US010242827B2

(12) United States Patent
Geier et al.

(10) Patent No.: US 10,242,827 B2
(45) Date of Patent: Mar. 26, 2019

(54) ELECTRICALLY CONTROLLED SWITCHING DEVICE INCLUDING SHAPE MEMORY ALLOY ELEMENT

(71) Applicant: Labinal Power Systems, Blagnac (FR)

(72) Inventors: David Michael Geier, Punta Gorda, FL (US); James Walter Broadwell, Parish, FL (US); James Michael McCormick, Bradenton, FL (US); Patrick Wellington Mills, Bradenton, FL (US)

(73) Assignee: SAFRAN ELECTRICAL & POWER, Blagnac (FR)

( * ) Notice: Subject to any disclaimer, the term of this patent is extended or adjusted under 35 U.S.C. 154(b) by 197 days.

(21) Appl. No.: 15/097,843

(22) Filed: Apr. 13, 2016

(65) Prior Publication Data

US 2016/0307718 A1 Oct. 20, 2016

Related U.S. Application Data

(60) Provisional application No. 62/147,019, filed on Apr. 14, 2015.

(51) Int. Cl.
*H01H 37/32* (2006.01)
*H01H 61/01* (2006.01)
(Continued)

(52) U.S. Cl.
CPC ..... *H01H 37/323* (2013.01); *H01H 47/002* (2013.01); *H01H 61/0107* (2013.01); *H01H 61/04* (2013.01); *H01H 71/145* (2013.01)

(58) Field of Classification Search
CPC ..... H01H 2061/0115–2061/0122; H01H 61/0107; H01H 37/323; H01H 71/145
See application file for complete search history.

(56) References Cited

U.S. PATENT DOCUMENTS 6,133,816 A 10/2000 Barnes et al.
6,972,659 B2 * 12/2005 von Behrens ..... E05B 47/0009 337/139
(Continued)

FOREIGN PATENT DOCUMENTS

| | | |
|---|---|---|
| DE | 102011117231 | 5/2012 |
| WO | 2009/137767 | 11/2009 |
| WO | 2010/142453 | 12/2010 |

OTHER PUBLICATIONS

International Search Report dated Jul. 28, 2016, International Application No. PCT/US2016/027284, six pages.

*Primary Examiner* — Ronald W Leja
*Assistant Examiner* — Christopher Clark
(74) *Attorney, Agent, or Firm* — Rankin, Hill & Clark LLP

(57) ABSTRACT

An electrically controlled switching device includes a support, a first contact coupled to the support, a second contact coupled to the support, an SMA element operably connected with the second contact, a sensor positioned on or adjacent to the SMA element, and a controller in communication with the sensor. The SMA element is configured to transform between a first shape and a different second shape responsive to an electrical pulse heating the SMA element to a transformation temperature. The sensor is configured to detect a detected temperature of the SMA element. The controller is configured to control the electrical pulse heating the SMA element. The controller receives signals from the sensor indicative of the detected temperature of the SMA element.

20 Claims, 1 Drawing Sheet

(51) Int. Cl.

| | |
|---|---|
| ***H01H 47/00*** | (2006.01) |
| ***H01H 61/04*** | (2006.01) |
| *H01H 71/14* | (2006.01) |

(56) References Cited

U.S. PATENT DOCUMENTS

| | | | | |
|---|---|---|---|---|
| 7,064,636 | B1 | 6/2006 | Walz et al. | |
| 8,220,259 | B1 * | 7/2012 | Cripe | F03G 7/065 310/306 |
| 9,425,014 | B2 | 8/2016 | Mills et al. | |

* cited by examiner

ELECTRICALLY CONTROLLED SWITCHING DEVICE INCLUDING SHAPE MEMORY ALLOY ELEMENT

BACKGROUND

Electrically controlled switching devices such as relays and contactors typically employ an electromagnetic coil that charges to open or close a switch. Improvement in the speed and weight, and simplicity of manufacturing these electrically controlled switching devices can be improved.

Some circuit interruption devices, which include circuit breakers, ON/OFF switches and the like have employed shape memory alloy (SMA) elements as a thermal circuit breaker or as a replacement of a solenoid in these devices. It can be difficult to quickly and accurately heat the SMA element at various operating temperature requirements. At a lower temperature, more energy is needed to raise the temperature of the SMA element to achieve a change in shape of the SMA element, but at a higher temperature less energy is required to avoid permanent damage to the SMA element.

SUMMARY

In view of the foregoing, an electrically controlled switching device includes a support, a first contact coupled to the support, a second contact coupled to the support, an SMA element operably connected with the second contact, a sensor positioned on or adjacent to the SMA element, and a controller in communication with the sensor. The SMA element is configured to transform between a first shape and a different second shape responsive to an electrical pulse heating the SMA element to a transformation temperature. The sensor is configured to detect a detected temperature of the SMA element. The controller is configured to control the electrical pulse heating the SMA element. The controller receives signals from the sensor indicative of the detected temperature of the SMA element.

An example of a method of operating an electrically controlled switching device includes delivering an electrical pulse to an SMA element, and adjusting the electrical pulse being delivered to the SMA element. The SMA element transforms between a first shape and a different second shape when heated to a transformation temperature. The electrical pulse is delivered to the SMA element to heat the SMA element to a desired temperature less than through transformation temperature. The electrical pulse being delivered to the SMA element is then adjusted to maintain a detected temperature of the SMA element at about the desired temperature.

Another example of an electrically controlled switching device includes a support, a first contact coupled to the support, a second contact coupled to the support, an SMA element operably connected with the second contact, and a controller. The second contact is moveable toward and away from the first contact. The SMA element is configured to transform between a first shape and a different second shape responsive to an electrical pulse heating the SMA element to a transformation temperature. The controller is configured to control the electrical pulse at least between a pre-heating state and a transformation state. In the pre-heating state, the controller controls the electrical pulse being delivered to the SMA element so as to heat the SMA element to a first desired temperature, which is less than the transformation temperature. In the transformation state, the controller controls the electrical pulse being delivered to the SMA element so as to heat the SMA element to a second desired temperature, which is equal to or greater than the transformation temperature.

DETAILED DESCRIPTION

Figure 2:
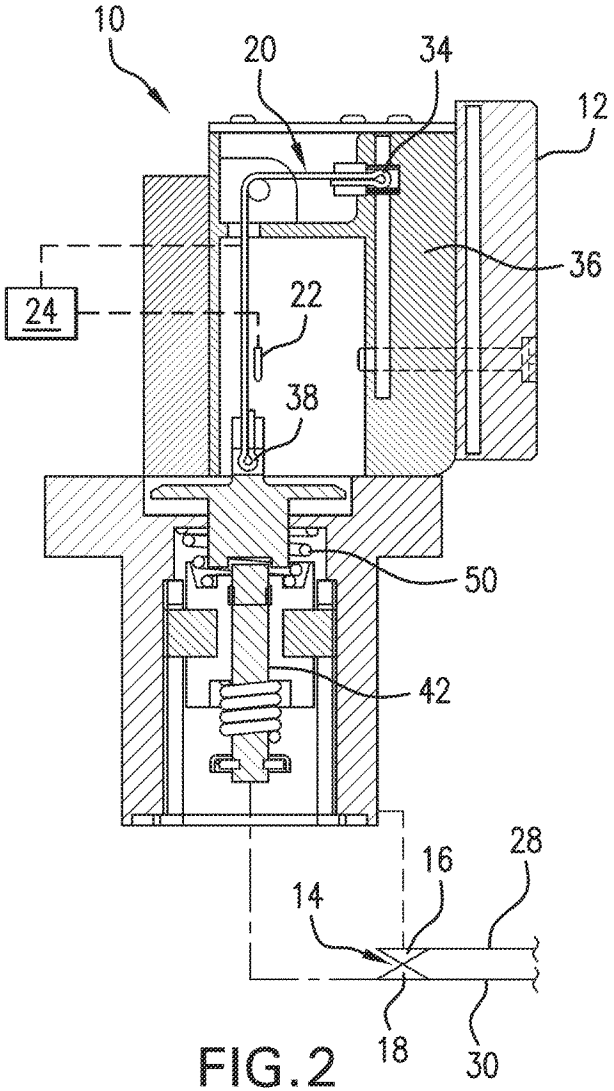
FIG. 2 is a schematic sectional view of the electrically controlled switching device with the contacts in an ON position.
Figure 1:
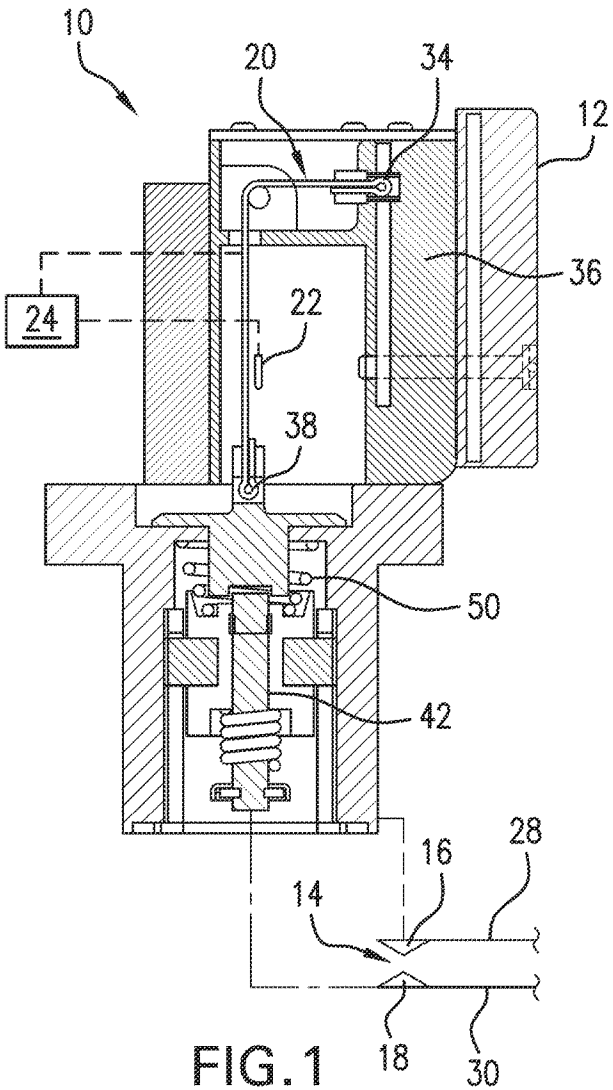
FIG. 1 is a schematic sectional view of an electrically controlled switching device having contacts in an OFF position.

An example of an electrically controlled switching device 10 is depicted in FIGS. 1 and 2. In general, the electrically controlled switching device 10 includes a support 12, a set of separable contacts 14 including a first contact 16 and a second contact 18, an SMA element 20, a sensor 22, and a controller 24. The first contact 16, which can also be referred to as a fixed contact in that the position of the first contact is fixed with respect to the support 12, can connect with a line conductor 28. The second contact 18, which can also be referred to as a moveable contact in that it is moveable with respect to the support 12, can connect with a load conductor 30. The electrically controlled switching device 10 is operable to move the set of contacts 14 between an open condition, which is shown in FIG. 1, and a closed condition, which is shown in FIG. 2. The electrically controlled switching device 10 is operable in at least two states: an ON state, which is shown in FIG. 2, where the first contact 16 is in contact with the second contact 18, which causes the line conductor 28 and the load conductor 30 to be electrically connected together, and an OFF state, which is shown in FIG. 1, where the first contact 16 is spaced from the second contact 18 so that the line conductor 28 is not electrically connected with the load conductor 30.

The support 12 can be an electrically nonconductive housing for the switching device 10. The first contact 16 is coupled to the support 12 and the second contact 18 is also coupled to the support 12, which is schematically depicted in FIGS. 1 and 2.

The SMA element 20 connects at a first end 34 to a heat sink 36, which is connected with the support 12, and at a second end 38 with a contact carrier 42 that is coupled with the second contact 18. The SMA element 20 can be made of a Single Crystal Shape Memory Alloy (SCSMA) that can be formed from a metallic alloy largely including copper-aluminum-nickel (Cu—Al—Ni) or other appropriate alloy. The SMA element 20 can also be formed from other known alloys that can change shape when heated as described below. An SCSMA has various advantages over a conventional SMA, and thus the SMA element 20 may desirably be formed of an SCSMA. Advantages of an SCSMA include significantly greater strain recovery that is generally 100% repeatable and complete. This is especially desirable when the electrically controlled switching device 10 is to operate between two states, e.g., an ON state and an OFF state.

As is generally understood in the art, an SMA material such as a conventional SMA or SCSMA, is typically formed to have an original shape. The SMA material can thereafter be deformed into a deformed shape while remaining at a temperature that is less than the transition temperature of the SMA material. Upon heating the SMA material to its transformation temperature, the SMA material transforms from its deformed shape back into its original shape. Upon cooling of the SMA material below its transformation temperature, the SMA material may return to the deformed shape.

With reference back to the illustrated embodiment, the SMA element 20 is configured to transform between a first shape and a different second shape responsive to heating the SMA element to a transformation temperature. More particularly, the SMA element 20 is configured to transform between a first shape and a different second shape responsive to an electrical pulse heating the SMA element 20 to the transformation temperature. In the depicted embodiment, the SMA element 20 is an elongated wire whose length changes when changing between the first shape and the second shape. The first shape is relatively shorter than the second shape. When the electrical pulse is applied to the SMA element 20 so as to heat the SMA element above the transformation temperature, the SMA element 20 shortens from its relatively longer first shape to its relatively shorter second shape. Such a shrinking or reduction in length of the SMA element 20 causes the carrier 42 to move, which results in the second contact 18 moving with respect to the first contact 16. When the SMA element 20 is heated to the transformation temperature by the electrical pulse applied to the SMA element 20, the length of the SMA element 20 shrinks a change in length sufficient to move the carrier 42 from a position shown in FIG. 1 to a position shown in FIG. 2.

The heat sink 36 in the illustrated embodiment is formed from aluminum or another appropriate thermally conductive material. The heat sink 36 is configured to rapidly cool the SMA element 20 to a temperature below the transformation temperature after the application of the electrical pulse that was applied to the SMA element 20 to raise the SMA element 20 above the transformation temperature has been stopped. The heat sink 36 operates in a known manner by removing heat from the SMA element 20, for example by dumping the heat into ambient.

As stated above, a second end 38 of the SMA element 20 is connected with the carrier 42, which results in the SMA element 20 being operably connected with the second contact 18 through the carrier 42. A spring 50 can be provided to bias the carrier 42 toward a first position shown in FIG. 1 placing the contacts 14 in the open position. The spring 50 acts against the support 12 to bias the carrier 42 toward the position shown in FIG. 1. When the SMA element 20 is heated above the transformation temperature, the SMA element 20 shrinks from the first shape shown in FIG. 1 to the second shape shown in FIG. 2, which moves the carrier 42 upward (per the orientation shown in FIG. 2) overcoming the biasing force of the spring 50. This movement of the carrier 42 results in movement of the second contact 18 toward the first contact 16, which places the contacts in the closed position shown in FIG. 2.

The sensor 22 is positioned on or adjacent the SMA element 20 and is configured to detect the temperature of the SMA element 20. The sensor 22 can be placed in contact with the SMA element 20 and/or placed in contact with the heat sink 36 to measure or detect the temperature of the SMA element 20. The sensor 22 can also be spaced from the SMA element 20 and use known technologies, e.g., IR technologies, to measure or detect the temperature of the SMA element 20.

The controller 24 is in communication with the sensor 22 and is configured to control the electrical pulse heating the SMA element 20. The controller 24 also receives signals from the sensor 22 indicative of the detected temperature of the SMA element 20. The controller 24 can receive power from a power source (not shown) to control the electrical pulse being delivered to the SMA element 20 based on the signals received from the sensor 22.

The controller 24 can control the electrical pulse being delivered to the SMA element 20 between a pre-heating state and a transformation state. In the electrically controlled switching device 10 in the illustrated embodiment, the controller 24 can control the electrical pulse being delivered to the SMA element 20 so as to pre-heat the SMA element to a desired temperature that is less than the transformation temperature. As such, in this pre-heating state, the SMA element 20 remains in the first shape shown in FIG. 1, but the SMA element 20 may have a temperature well above ambient, for example. For example, in the pre-heating state the temperature of the SMA element 20 may be about 10 degrees to about 20 degrees C. less than the transformation temperature so that when it is desired to change the shape of the SMA element 20, the SMA element 20 can be more quickly transformed from the first shape to the second shape since the temperature differential between the temperature of the SMA element 20 and the transformation temperature is smaller as compared to keeping the SMA 20 element at ambient temperature.

As stated above, the controller 24 receives signals from the sensor 22 indicative of the detected temperature of the SMA element 20. The controller 24 is configured to control the electrical pulse while allowing for the delivery of the electrical pulse to the SMA element 20 such that the detected temperature is less than the transformation temperature, but typically greater than ambient temperature. The controller 24 is configured to compare the detected temperature, which is detected by the sensor 22, to the desired temperature and to adjust the electrical pulse based on a comparison between the detected temperature and the desired temperature. For example, the desired temperature can be a first desired temperature which is about 10 degrees to about 20 degrees C. less than the transformation temperature in the pre-heating state. As such, the controller 24 can compare the detected temperature, which is indicative of the actual temperature of the SMA element 20, and compare this to the first desired temperature, which can be slightly less than the transformation temperature. If the detected temperature is not within the range of about 10 degrees to about 20 degrees C. less than the transformation temperature, then the controller 24 can adjust the signal to deliver more power to the SMA element 20 to increase the temperature of the SMA element 20. The controller 24 is also configured to control the electrical pulse while allowing for the delivery of the electrical pulse to the SMA element 20 so as to heat the SMA element 20 to a second desired temperature, which is greater than or equal to the transformation temperature. The amount of power being delivered to the SMA element 20 during this transformation state is enough to heat the SMA element 20 to or above the transformation temperature so that the SMA element 20 transforms from the first shape to the different second shape. As explained above, this can result in a shortening of the SMA element 20, which moves the carrier 42 from the position shown in FIG. 1 to the position shown in FIG. 2, so as to close the contacts 14 placing the electrically controlled switching device in the ON state. By providing signals indicative of the temperature of the SMA element 20 from the sensor 22 to the controller 24, the controller 24 can adjust the electrical pulse to compensate for the difference (or error) between the desired temperature and the detected (or actual) temperature of the SMA element 20.

A method of operating an electrically controlled switching device, such as the switching device 10 depicted in FIGS. 1 and 2, includes delivering an electrical pulse to an SMA element, such as the SMA element 20, to heat the SMA element to a desired temperature less than the transformation temperature. It is during this stage that a controller, e.g., the controller 24, controls the electrical pulse so that the electrical pulse is in a pre-heating state to heat the SMA element 20 to a first desired temperature, which is less than the transformation temperature. The method further includes adjusting the electrical pulse being delivered to the SMA element 20 to maintain a detected temperature of the SMA element 20 at about this desired temperature. As explained above, for example, the electrical pulse being delivered to the SMA element 20 can be adjusted so that the desired temperature is about 10 degrees to about 20 degrees C. less than the transformation temperature. The controller 24 can be programmed to maintain the SMA element 20 within this desired temperature range and to accommodate for any error between the desired temperature and the detected temperature. This can allow for a faster transformation between the first shape and the second shape when it is desired to change the SMA element 20 from the first shape to the second shape.

The method further includes detecting the detected temperature of the SMA element 20 using the sensor, such as the sensor 22 depicted in FIGS. 1 and 2. The method further includes comparing the detected temperature, which can be detected by the sensor 22, to the desired temperature in a controller, such as the controller 24, which is in communication with the sensor. The electrically controlled switching device can operate between an ON state and an OFF state. The method can further include receiving a signal in the controller 24 to change an ON/OFF state of the electrically controlled switching device. The controller 24 can receive this change in state signal from outside of the electrically controlled switching device 10. The method further includes adjusting the electrical pulse being delivered to the SMA element 20 so as to heat the SMA element 20 to a second desired temperature which is greater than or equal to the transformation temperature, upon receiving a signal and the controller 24 to change an ON/OFF state of the electrically controlled switching device. In other words, when it is desired to change the position of the contacts 14 from what is shown in FIG. 1 to what is shown in FIG. 2, a signal can be delivered to the controller 24, which can then adjust the electrical pulse being delivered to the SMA element 20. The method can further include receiving another signal in the controller 24 to change the ON/OFF state of the electrically controlled switching device 10. For example, with the contacts 14 shown in the position shown in FIG. 2, another signal can be received by the controller 24 to place the contacts in the open position. As such, the method can further include stopping delivery of the electrical pulse to the SMA element 20, which can allow for the transformation of the SMA element 20 from the second shape shown in FIG. 2 back to the first shape shown in FIG. 1. Heat is dissipated from the SMA element 20 into the heat sink 36, which reduces the temperature of the SMA element 20, which allows for the SMA element 20 to move from the second shape (FIG. 2) back to the first shape shown in FIG. 1. As such, stopping the delivery of the electrical pulse to the SMA element 20 can further include stopping delivery of the electrical pulse until the SMA element 20 reaches a first desired temperature, which is about 10 degrees to about 20 degrees C. less than the transformation temperature. While remaining in the state shown in FIG. 1, the electrical pulse can be adjusted to the SMA element 20 to maintain the detected temperature of the SMA element 20 at about the first desired temperature, which is less than the transformation temperature.

An electrically controlled switching device and a method of operating an electrically controlled switching device have been described above with particularity. Modifications and alterations will occur to those upon reading and understanding the preceding detailed description. As just one example, the SMA element could move from the first shape to the second shape to change the state of the switching device from ON to OFF, which is opposite to that shown in the FIGS. In this example, the shrinking of the SMA element could move the contacts out of contact with one another. The invention is not limited to only the embodiments described above. Instead, the invention is broadly defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An electrically controlled switching device comprising:

a support;

a first contact coupled to the support;

a second contact coupled to the support;

a shape memory alloy (SMA) element operably connected with the second contact and configured to transform between a first shape and a different second shape responsive to an electrical pulse heating the SMA element to a transformation temperature;

a sensor positioned on or adjacent to the SMA element and configured to detect a detected temperature of the SMA element;

a heat sink directly connected to the support;

a contact carrier directly coupled with the second contact, wherein the SMA element includes a first end directly and fixedly connected to the heat sink and a second end directly and fixedly connected to the contact carrier; and a controller in communication with the sensor and configured to control the electrical pulse heating the SMA element, wherein the controller receives signals from the sensor indicative of the detected temperature of the SMA element.

2. The device of claim 1, wherein the controller is configured to control the electrical pulse based on the signals received from the sensor.

3. The device of claim 2, wherein the controller is configured to control the electrical pulse while allowing for the delivery of the electrical pulse to the SMA element such that the detected temperature is less than the transformation temperature.

4. The device of claim 2, wherein the controller is configured to control the electrical pulse while allowing for the delivery of the electrical pulse to the SMA element so as to heat the SMA element to a first desired temperature, which is less than the transformation temperature.

5. The device of claim 4, wherein the controller is configured to compare the detected temperature to the first desired temperature and to adjust the electrical pulse based on a comparison between the detected temperature and the first desired temperature.

6. The device of claim 4, wherein the first desired temperature is about 10 degrees to about 20 degrees C. less than the transformation temperature.

7. The device of claim 2, wherein the controller is configured to control the electrical pulse while allowing for the delivery of the electrical pulse to the SMA element so as to heat the SMA element to a second desired temperature, which is greater than or equal to the transformation temperature.

8. A method of operating an electrically controlled switching device, the method comprising:

connecting a heat sink directly to a support;

coupling a contact carrier directly with a second contact;

delivering an electrical pulse to a shape memory alloy (SMA) element, which transforms between a first shape and a different second shape when heated to a transformation temperature, to heat the SMA element to a desired temperature less than the transformation temperature;

connecting a first end of the SMA element directly and fixedly to the heat sink and a second end of the SMA element directly and fixedly to the contact carrier;

detecting a detected temperature of the SMA element using a sensor positioned on or adjacent to the SMA element; and adjusting the electrical pulse being delivered to the SMA element to maintain the detected temperature of the SMA element at about the desired temperature.

9. The method of claim 8, further comprising:

comparing the detected temperature to the desired temperature in a controller in communication with the sensor.

10. The method of claim 8, wherein the desired temperature less than the transformation temperature is a first desired temperature about 10 degrees to about 20 degrees C. less than the transformation temperature.

11. The method of claim 8, further comprising:

receiving a signal in the controller to change an ON/OFF state of the electrically controlled switching device; and adjusting the electrical pulse being delivered to the SMA element so as to heat the SMA element to a second desired temperature, which is greater than or equal to the transformation temperature.

12. The method of claim 11, further comprising:

receiving another signal in the controller to change an ON/OFF state of the electrically controlled switching device; and stopping delivery of the electrical pulse to the SMA element.

13. The method of claim 12, wherein stopping the delivery of the electrical pulse to the SMA element further includes stopping delivery of the electrical pulse to the SMA element until the SMA element reaches a first desired temperature about 10 degrees to about 20 degrees C. less than the transformation temperature, and adjusting the electrical pulse being delivered to the SMA element to maintain the detected temperature of the SMA element at about the first desired temperature.

14. An electrically controlled switching device comprising:

a support;

a first contact coupled to the support;

a second contact coupled to the support and movable toward and away from the first contact;

a shape memory alloy (SMA) element operably connected with the second contact and configured to transform between a first shape and a different second shape responsive to an electrical pulse heating the SMA element to a transformation temperature;

a sensor positioned on or adjacent to the SMA element and configured to detect a detected temperature of the SMA element;

a heat sink directly connected to the support;

a contact carrier directly coupled with the second contact, wherein the SMA element includes a first end directly and fixedly connected to the heat sink and a second end directly and fixedly connected to the contact carrier; and a controller configured to control the electrical pulse at least between a pre-heating state and a transformation state, wherein in the pre-heating state the controller controls the electrical pulse being delivered to the SMA element so as to heat the SMA element to a first desired temperature, which is less than the transformation temperature, wherein in the transformation state the controller controls the electrical pulse being delivered to the SMA element so as to heat the SMA element to a second desired temperature, which is equal to or greater than the transformation temperature, and wherein the controller receives signals from the sensor indicative of the temperature of the SMA element.

15. The device of claim 14, wherein the controller is configured to control the electrical pulse based on the signals received from the sensor.

16. The device of claim 15, wherein the controller is configured to control the electrical pulse while allowing for the delivery of the electrical pulse to the SMA element such that the detected temperature is less than the transformation temperature.

17. The device of claim 14, wherein the controller is configured to compare the detected temperature to the first desired temperature and to adjust the electrical pulse based on a comparison between the detected temperature and the first desired temperature.

18. The device of claim 14, wherein the first desired temperature is about 10 degrees to about 20 degrees C. less than the transformation temperature.

19. The device of claim 14, further comprising:

a spring that linearly biases the contact carrier away from the sensor.

20. The device of claim 1, further comprising:

a spring that linearly biases the contact carrier away from the sensor.

* * * * *